US012060783B2

(12) United States Patent
Krupa et al.

(10) Patent No.: US 12,060,783 B2
(45) Date of Patent: Aug. 13, 2024

(54) SYSTEM AND METHOD FOR AN AUTOMATED AND INTELLIGENT FRAC PUMPING

(71) Applicant: FMC Technologies, Inc., Houston, TX (US)

(72) Inventors: Andrew Krupa, Houston, TX (US); Corey Massey, Houston, TX (US); James Cook, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 208 days.

(21) Appl. No.: 17/651,716

(22) Filed: Feb. 18, 2022

(65) Prior Publication Data

US 2022/0268141 A1 Aug. 25, 2022

Related U.S. Application Data

(60) Provisional application No. 63/153,607, filed on Feb. 25, 2021.

(51) Int. Cl.

| | |
|---|---|
| ***E21B 43/26*** | (2006.01) |
| ***E21B 34/02*** | (2006.01) |
| ***E21B 47/00*** | (2012.01) |

(52) U.S. Cl.

CPC ..... *E21B 43/2607* (2020.05); *E21B 34/02* (2013.01); *E21B 47/00* (2013.01); *E21B 2200/20* (2020.05)

(58) Field of Classification Search

CPC ..... E21B 43/2607; E21B 34/02; E21B 47/00
USPC ..... 166/308.1
See application file for complete search history.

(56) References Cited

U.S. PATENT DOCUMENTS

| | | | |
|---|---|---|---|
| 10,174,584 | B2 | 1/2019 | Kajaria et al. |
| 10,563,778 | B2 | 2/2020 | Painter |
| 10,801,294 | B2 | 10/2020 | Jespersen et al. |
| 11,047,189 | B2 | 6/2021 | Fernandes et al. |
| 11,066,915 | B1 * | 7/2021 | Yeung ..... E21B 43/2607 |
| 11,137,109 | B2 | 10/2021 | Babineaux et al. |
| 11,306,835 | B1 | 4/2022 | Dille et al. |
| 11,396,799 | B2 | 7/2022 | Johnson et al. |
| 11,401,779 | B2 | 8/2022 | Kuehn et al. |
| 11,460,368 | B2 | 10/2022 | Yeung et al. |

(Continued)

OTHER PUBLICATIONS

*Wellhead Systems, Inc.* v. *Downing Wellhead Equipment, LLC,* Patent Owner Preliminary Response, United States Patent and Trademark Office Before the Patent Trial and Appeal Board, IPR2024-00256, filed Mar. 8, 2024.

(Continued)

*Primary Examiner* — Tara Schimpf
*Assistant Examiner* — Patrick F Lambe
(74) *Attorney, Agent, or Firm* — Erise IP, P.A.

(57) ABSTRACT

A system may have a built hydraulic fracturing system with a plurality of devices connected together and in fluid communication with one or more wells. The system may also include at least one continuous pumping operations for one or more wells and a fracturing pumping plan provided on a software application. The fracturing plan may include instructions to perform at least one continuous pumping operations for the one or more wells. The instructions may include a sequence of valve operations to direct fluid flow through a selected path into the one or more wells.

9 Claims, 9 Drawing Sheets

(56) References Cited

U.S. PATENT DOCUMENTS

| | | | | |
|---|---|---|---|---|
| 2009/0194273 | A1* | 8/2009 | Surjaatmadja | E21B 43/26 166/250.1 |
| 2014/0352968 | A1 | 12/2014 | Pitcher et al. | |
| 2017/0123437 | A1 | 5/2017 | Boyd et al. | |
| 2017/0275980 | A1 | 9/2017 | Kajaria | |
| 2017/0336022 | A1 | 11/2017 | Gouge | |
| 2018/0179848 | A1 | 6/2018 | Cherewyk | |
| 2020/0248529 | A1 | 8/2020 | Beason et al. | |
| 2020/0347990 | A1 | 11/2020 | McKim | |
| 2021/0188616 | A1 | 6/2021 | Shock | |
| 2021/0262315 | A1 | 8/2021 | Beason et al. | |
| 2021/0301638 | A1 | 9/2021 | Boyd | |
| 2021/0301933 | A1 | 9/2021 | Asanoma | |
| 2021/0324706 | A1 | 10/2021 | Beason et al. | |
| 2022/0113702 | A1* | 4/2022 | Jaaskelainen | E21B 43/16 |
| 2022/0268141 | A1* | 8/2022 | Krupa | E21B 43/2607 |

OTHER PUBLICATIONS

*Wellhead Systems, Inc.* v. *Downing Wellhead Equipment, LLC,* Patent Owner Preliminary Response Ex.2001, Wayback Machine—Introducing Continuous Pumping; The Wayback Machine https://web.archive.org/web/20201020115107/https://downingusa.com/freedomseries/continuouspumping/, United States Patent and Trademark Office Before the Patent Trial and Appeal Board, IPR2024-00256, filed Mar. 8, 2024.

Canadian Patent Application 3,150,086 Examination Search Report issued Apr. 3, 2024.

Office Action issued in Canadian Application No. 3,150,086, mailed on Sep. 21, 2023 (3 Pages).

* cited by examiner

SYSTEM AND METHOD FOR AN AUTOMATED AND INTELLIGENT FRAC PUMPING

BACKGROUND

Hydraulic fracturing is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of a formation and bypasses any damage that may exist in the near-wellbore area. Furthermore, hydraulic fracturing is used to increase the rate at which fluids, such as petroleum, water, or natural gas, can be recovered from subterranean natural reservoirs. Reservoirs are typically porous sandstones, limestones or dolomite rocks, but also include "unconventional reservoirs" such as shale rock or coal beds. Hydraulic fracturing enables the extraction of natural gas and oil from rock formations deep below the earth's surface (e.g., generally 2,000-6,000 m (5,000-20,000 ft)), which is greatly below typical groundwater reservoir levels. At such depth, there may be insufficient permeability or reservoir pressure to allow natural gas and oil to flow from the rock into the wellbore at high economic return. Thus, creating conductive fractures in the rock is instrumental in extraction from naturally impermeable reservoirs.

A wide variety of hydraulic fracturing equipment is used in oil and natural gas fields, such as a slurry blender, one or more high-pressure, high-volume fracturing pumps and a monitoring unit. Additionally, associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Fracturing equipment operates over a range of pressures and injection rates, and can reach up to 100 megapascals (15,000 psi) and 265 litres per second (9.4 cu ft/s) (100 barrels per minute).

With the wide variety of hydraulic fracturing equipment at a well site, the hydraulic fracturing operation may be conducted. A hydraulic fracturing operation requires planning, coordination, and cooperation of all parties. Safety is always the primary concern in the field, and it begins with a thorough understanding by all parties of their duties. Conventional hydraulic fracturing operations are dependent on workers being present to oversee and conduct said operation over the full lifetime to complete said operation.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, this disclosure relates to a method. The method may include pumping fluids into a first well via at least one pump manifold by opening a first set of valves. The method may also include pumping the fluids into a second well via the at least one pump manifold while continuously pumping the fluids into the first well by opening a second set of valves. The method further includes closing the first set of valves to stop pumping the fluids into the first well and isolating and continuously pumping the fluids into the second well.

In another aspect, this disclosure relates to a method for providing a fracturing pumping plan on a software application. The fracturing plan may include pre-made instructions to perform at least one continuous pumping operations for one or more wells. The method may also include executing the fracturing pumping plan to perform the at least one continuous pumping operations in a built hydraulic fracturing system coupled to the one or more wells.

In one aspect, this disclosure relates to a system with a built hydraulic fracturing system having a plurality of devices connected together and in fluid communication with one or more wells. The system may also include at least one continuous pumping operations for one or more wells and a fracturing pumping plan provided on a software application. The fracturing plan may include instructions to perform at least one continuous pumping operations for the one or more wells. The instructions may include a sequence of valve operations to direct fluid flow through a selected path into the one or more wells.

Other aspects and advantages will be apparent from the following description and the appended claims.

DETAILED DESCRIPTION

Figure 1:
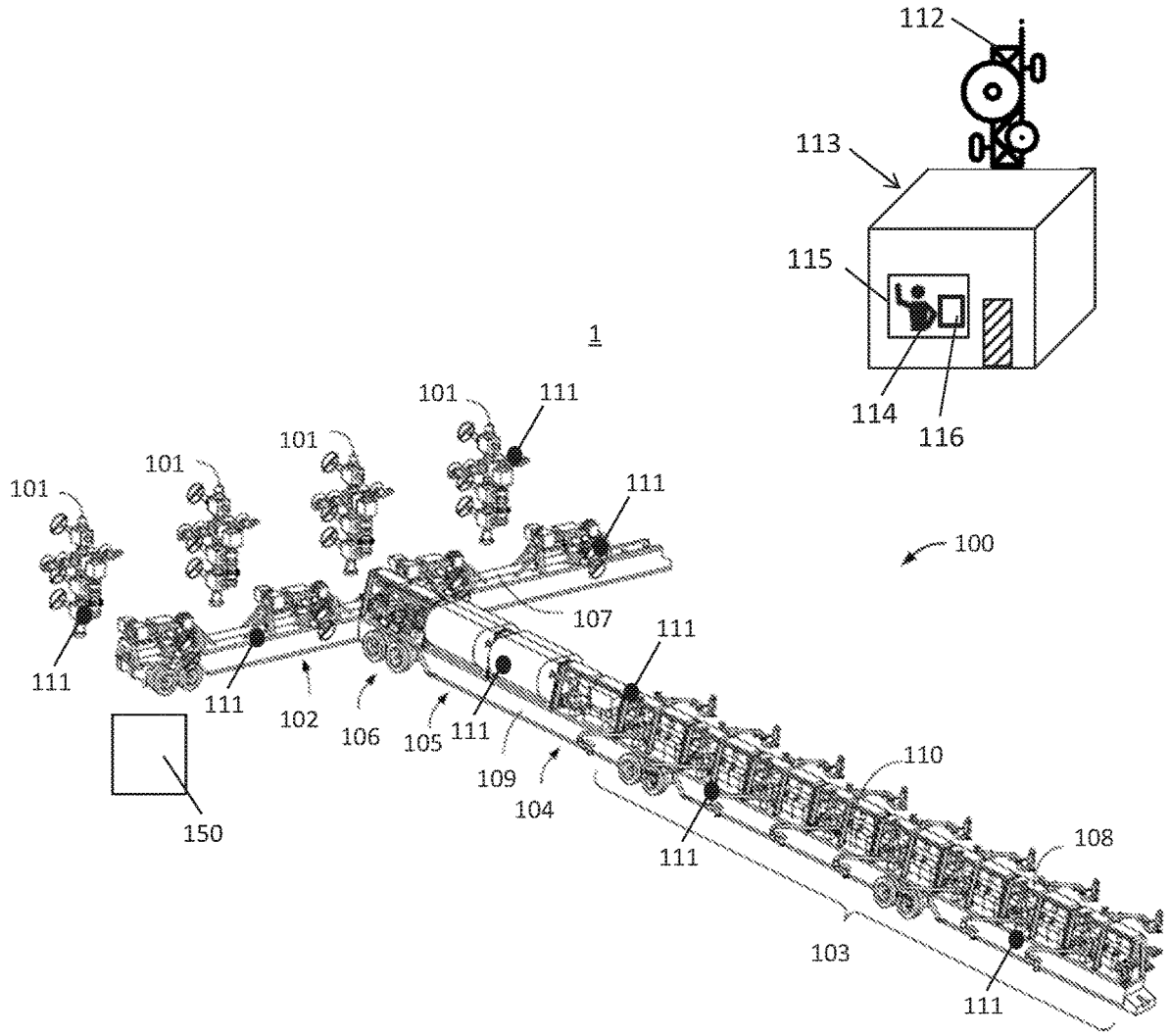
FIG. 1 illustrates a view of a hydraulic fracturing system at a well site according to one or more embodiments of the present disclosure.

Embodiments of the present disclosure are described below in detail with reference to the accompanying figures. Wherever possible, like or identical reference numerals are used in the figures to identify common or the same elements. The figures are not necessarily to scale and certain features and certain views of the figures may be shown exaggerated in scale for purposes of clarification. Further, in the following detailed description, numerous specific details are set forth to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection, and is not limited to either unless expressly referenced as such.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. The embodiments are described merely as examples of useful applications, which are not limited to any specific details of the embodiments herein.

In a fracturing operation, a plurality of equipment (i.e., fracturing equipment) is disposed around a rig site to perform a wide variety of fracturing operations during a life of the fracturing process (i.e., rig site preparation to fracturing to removal of fracturing equipment) and form a built hydraulic fracturing system. At the site, there is a wide variety of fracturing equipment for operating the fracturing, such as a slurry blender, one or more high-pressure, high-volume fracturing pumps, a monitoring unit, fracturing tanks, one or more units for storage and handling of proppant, high-pressure treating iron, a chemical additive unit (used to accurately monitor chemical addition), low-pressure flexible hoses, and many gauges and meters for flow rate, fluid density, treating pressure, etc. The fracturing equipment encompass any number of components that are durable, sensitive, complex, simple components, or any combination thereof. Furthermore, it is also understood that one or more of the fracturing equipment may be interdependent upon other components. Once the fracturing equipment is set up, typically, the fracturing operation may be capable of operating 24 hours a day.

Conventional hydraulic fracturing systems in the oil and gas industry typically require an entire team of workers to ensure proper sequencing. For example, a valve team may meet, plan, and agree on a valve sequence to then actuate the valves. As a result, conventional hydraulic fracturing systems are prone to human errors resulting in improper actuation of valves and expensive damage and non-productive time (NPT).

One or more embodiments in the present disclosure may be used to overcome such challenges as well as provide additional advantages over conventional hydraulic fracturing systems. For example, in some embodiments, an automated hydraulic fracturing system including a computing system described herein and a plurality of sensors working in conjunction with built hydraulic fracturing system may streamline and improve efficiency as compared with conventional hydraulic fracturing systems due, in part, to reducing or eliminating human interaction with the hydraulic fracturing systems by automating fracturing operations for continuous pumping in one or more wells.

In one aspect, embodiments disclosed herein relate to automating a hydraulic fracturing system that may perform continuous pumping processes in a hydraulic fracturing operation. In another aspect, embodiments disclosed herein relate to automatic hydraulic fracturing pumping. Automatic hydraulic fracturing pumping may be used, for example, to plan and execute hydraulic fracturing pumping operations from one well to another well. Further, automatic hydraulic fracturing pumping may be used for continuous non-stop pumping for one or more wells.

Automatic hydraulic fracturing pumping system may utilize a pumping plan provided on a software application, which may include pre-made instructions to perform multiple pumping processes carried out by the hydraulic fracturing system. Such fracturing plans may include automating valves within the hydraulic fracturing system to have a valve sequencing (e.g., opening and closing) to direct fluids (e.g., frac fluid) in a selected path and/or control pressure and pump rates within the system. As used herein, a valve may be interchangeably referred to as a gate valve in the present disclosure. Further, fluids may refer to slurries, liquids, gases, and/or mixtures thereof. In some embodiments, solids may be present in the fluids. Automating a hydraulic fracturing pumping system according to one or more embodiments described herein may provide a cost-effective alternative to conventional hydraulic fracturing systems. The embodiments are described merely as examples of useful applications, which are not limited to any specific details of the embodiments herein.

FIG. 1 shows an automated hydraulic fracturing pumping system according to embodiments of the present disclosure. The automated hydraulic fracturing pumping system includes a built hydraulic fracturing pumping system 100 having a plurality of connected together fracturing equipment at a rig site 1. The built hydraulic fracturing pumping system 100 may include at least one wellhead assembly 101 (e.g., a Christmas tree) coupled to at least one time and efficiency (TE) or zipper manifold 102 through one or more flow lines (not shown). The hydraulic fracturing pumping system 100 may further include at least one pump manifold 103 in fluid communication with the zipper manifold 102. In use, the at least one pump manifold 103 may be fluidly connected to and receive pressurized fracking fluid from one or more high pressure pumps (not shown), and direct that pressurized fracking fluid to the zipper manifold 102, which may include one or more valves that may be closed to isolate the wellhead assembly 101 from the flow of pressurized fluid within the zipper manifold 102 and pump manifold 103.

Additionally, the at least one wellhead assembly 101 may comprise one or more valves fluidly connected to a wellhead that are adapted to control the flow of fluid into and out of the wellhead. Typical valves associated with a wellhead assembly include, but are not limited to, upper and lower master valves, wing valves, and swab valves, each named according to a respective functionality on the wellhead assembly 101.

Additionally, the valves of the at least one wellhead assembly 101 and zipper manifold 102 may be gate valves that may be actuated, but not limited to, electrically, hydraulically, pneumatically, or mechanically. In some embodiments, the built hydraulic fracturing pumping system 100 may include a system 150 that may provide power to actuate the valves of the built hydraulic fracturing pumping system 100. In a non-limiting example, when the valves are hydraulically actuated, the system 150 may include a hydraulic skid with accumulators to provide the hydraulic pressure required to open and close the valves, when needed. The system 150 may also be interchangeably referred to as a valve control system in the present disclosure.

Further, the built hydraulic fracturing pumping system 100 includes a plurality of additional rig equipment for fracturing operations. In a non-limiting example, the built hydraulic fracturing pumping system 100 may include at least one auxiliary manifold 104, at least one pop-off/bleed-off tank manifold 105, at least one isolation manifold 106, and/or a spacer manifold 107. The at least one pump manifold 103 may be used to inject a slurry into the wellbore to fracture the hydrocarbon bearing formation, and thereby produce channels through which the oil or gas may flow, by providing a fluid connection between pump discharge and the hydraulic fracturing pumping system 100. The auxiliary manifold 104 may provide a universal power and control unit, including a power unit and a primary controller of the hydraulic fracturing pumping system 100. The at least one pop-off/bleed-off tank manifold 105 may allow discharge pressure from bleed off/pop off operations to be immediately relieved and controlled. The at least one isolation manifold 106 may be used to allow pump-side equipment and well-side equipment to be isolated from each other. The spacer manifold 107 may provide spacing between adjacent equipment, which may include equipment to connect between the equipment in the adjacent manifolds.

In one or more embodiments, the manifolds 102, 103, 104, 105, 106, 107 may each include a primary manifold connection 110 with a single primary inlet and a single primary outlet and one or more primary flow paths extending therebetween mounted on same-sized A-frames 108. Additionally, the built hydraulic fracturing pumping system 100 may be modular to allow for easy transportation and installation on the rig site. In a non-limiting example, the built hydraulic fracturing pumping system 100 in accordance with the present disclosure may utilize the modular fracturing pad structure systems and methods, according to the systems and methods as described in U.S. patent application Ser. No. 15/943,306, which the entire teachings of are incorporated herein by reference. While not shown by FIG. 1, one of ordinary skill in the art would understand the built hydraulic fracturing pumping system 100 may include further equipment, such as a blowout preventer (BOP), completions equipment, topdrive, automated pipe handling equipment, etc. Further, the built hydraulic fracturing pumping system 100 may include a wide variety of equipment for different uses; and thus, for the purposes of simplicity, the terms "plurality of devices" or "rig equipment" are used hereinafter to encompass the wide variety equipment used to form a built hydraulic fracturing system comprising a plurality of devices connected together.

Still referring to FIG. 1, the automated hydraulic fracturing system may further include a plurality of sensors 111 provided at the rig site 1. The plurality of sensors 111 may be associated with some or all of the plurality of devices of the built hydraulic fracturing pumping system 100, including components and subcomponents of the devices. In a non-limiting example, some of the plurality of sensors 111 may be associated with each of the valves of the wellhead assembly 101 and zipper manifold 102. The plurality of sensors 111 may be a microphone, ultrasonic, ultrasound, sound navigation and ranging (SONAR), radio detection and ranging (RADAR), acoustic, piezoelectric, accelerometers, temperature, pressure, weight, position, or any sensor in the art to detect and monitor the plurality of devices. The plurality of sensors 111 may be disposed on the plurality of devices at the rig site 1 and/or during the manufacturing of said devices. It is further envisioned that the plurality of sensors 111 may be provided inside a component of the plurality of devices. Additionally, the plurality of sensors 111 may be any sensor or device capable of wireline monitoring, valve monitoring, pump monitoring, flow line monitoring, accumulators and energy harvesting, and equipment performance and damage.

The plurality of sensors 111 may be used to collect data on status, process conditions, performance, and overall quality of the device that said sensors are monitoring, for example, on/off status of equipment, open/closed status of valves, pressure readings, temperature readings, and others. One skilled in the art will appreciate the plurality of sensors 111 may aid in detecting possible failure mechanisms in individual components, approaching maintenance or service, and/or compliance issues. In some embodiments, the plurality of sensors 111 may transmit and receive information/instructions wirelessly and/or through wires attached to the plurality of sensors 111. In a non-limiting example, each sensor of the plurality of sensors 111 may have an antenna (not shown) to be in communication with a master antenna 112 on any housing 113 at the rig site 1. The housing 113 may be understood to one of ordinary skill to be any housing typically required at the rig site 1, such as a control room where an operator 114 may be within to operate and view the rig site 1 from a window 115 of the housing 113. It is further envisioned that the plurality of sensors 111 may transmit and receive information/instructions to a remote location away from rig site 1. In a non-limiting example, the plurality of sensors 111 may collect signature data on the plurality of devices and deliver a real-time health analysis of the plurality of devices.

In one aspect, a plurality of sensors 111 may be used to record and monitor the hydraulic fracturing equipment to aid in carrying out the fracturing plan. Additionally, data collected from the plurality of sensors 111 may be logged to create real-time logging of operational metrics, such as duration between various stages and determining field efficiency. In a non-limiting example, the plurality of sensors 111 may aid in monitoring a valve position to determine current job state and provides choices for possible stages. In some examples, the plurality of sensors may provide information such that a current state of the hydraulic fracturing operation, possible failures of hydraulic fracturing equipment, maintenance or service requirements, and compliance issues that may arise is obtained. By obtaining such information, the automated hydraulic fracturing systems may form a closed loop valve control system, valve control and monitoring without visual inspection, and reduce or eliminate human interaction with the hydraulic fracturing equipment.

An automated hydraulic fracturing system may include a computing system for implementing methods disclosed herein. The computing system may include a human machine interface ("HMI") using a software application and may be provided to aid in the automation of a built hydraulic fracturing system. In some embodiments, an HMI 116, such as a computer, control panel, and/or other hardware components may allow the operator 114 to interact through the HMI 116 with the built hydraulic fracturing pumping system 100 in an automated hydraulic fracturing system. The HMI 116 may include a screen, such as a touch screen, used as an input (e.g., for a person to input commands) and output (e.g., for display) of the computing system. In some embodiments, the HMI 116 may also include switches, knobs, joysticks and/or other hardware components which may allow an operator to interact through the HMI 116 with the automated hydraulic fracturing systems.

An automated hydraulic fracturing pumping system, according to embodiments herein, may include the plurality of sensors 111, valve control system 150, and data acquisition hardware disposed on or around the hydraulic fracturing equipment, such as on valves, pumps and pipelines. In some embodiments, the data acquisition hardware is incorporated into the plurality of sensors 111. In a non-limiting example, hardware in the automated hydraulic fracturing systems, such as sensors, wireline monitoring devices, valve monitoring devices, pump monitoring devices, flow line monitoring devices, hydraulic skids including accumulators and energy harvesting devices, may be aggregated into single software architecture.

In one or more embodiments, a single software architecture according to embodiments of the present disclosure may be implemented in one or more computing systems having the HMI 116 built therein or connected thereto. The single software architecture may be any combination of mobile, desktop, server, router, switch, embedded device, or other types of hardware may be used. For example, a computing system may include one or more computer processors, non-persistent storage (e.g., volatile memory, such as random-access memory (RAM), cache memory), persistent storage (e.g., a hard disk, an optical drive such as a compact disk (CD) drive or digital versatile disk (DVD) drive, a flash memory, etc.), a communication interface (e.g., Bluetooth interface, infrared interface, network interface, optical interface, etc.), and numerous other elements and functionalities.

A computer processor(s) may be an integrated circuit for processing instructions. For example, the computer processor(s) may be one or more cores or micro-cores of a processor. Fracturing pumping plans according to embodiments of the present disclosure may be executed on a computer processor. The computing system may also include one or more input devices, such as a touchscreen, keyboard, mouse, microphone, touchpad, electronic pen, or any other type of input device. Additionally, it is also understood that the computing system may receive data from the sensors described herein as an input.

A communication interface may include an integrated circuit for connecting the computing system to a network (not shown) (e.g., a local area network (LAN), a wide area network (WAN) such as the Internet, mobile network, or any other type of network) and/or to another device, such as another computing device. Further, the computing system may include one or more output devices, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s), non-persistent storage, and/or persistent storage. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure. More specifically, the software instructions may correspond to computer readable program code, that when executed by a processor(s), may perform one or any of the automated hydraulic fracturing systems features described herein, including that associated with data interpretation and automated hydraulic fracturing pumping systems.

The computing system may implement and/or be connected to a data repository, such as a database, which may be used to store data collected from an automated hydraulic fracturing system according to embodiments of the present disclosure. Such data may include, for example, valve data, such as identification of which valves in the system are open or closed, time recordings of when valves in the system open or close, time periods for how long valves in the system are open or closed, and valve pressure data. A database is a collection of information configured for ease of data retrieval, modification, re-organization, and deletion. The computing system may include functionality to present raw and/or processed data, such as results of comparisons and other processing performed by an automation planner. For example, data may be presented through the HMI 116. The HMI 116 may include a graphical user interface (GUI) that displays information on a display device of the HMI 116. The GUI may include various GUI widgets that organize what data is shown as well as how data is presented to a user (e.g., data presented as actual data values through text, or rendered by the computing device into a visual representation of the data, such as through visualizing a data model).

The above description of functions presents only a few examples of functions performed by the computing system of automated hydraulic fracturing pumping systems herein. Other functions may be performed using one or more embodiments of the disclosure.

The plurality of sensors 111 work in conjunction with the computing system to display information on the HMI 116. Having the automated hydraulic fracturing pumping system may significantly improve overall performance of the rig, rig safety, reduced risk of NPT and many other advantages. Embodiments of the present disclosure describe control systems, measurements, and strategies to automating rig operation (e.g., fracturing operations). It is further envisioned that the automated hydraulic fracturing pumping system may locally collect, analyze, and transmit data to a cloud in real-time to provide information, such as equipment health, performance metrics, alerts, and general monitoring, to third parties remotely or through the HMI 116.

In some embodiments, a fracturing pumping plan may be provided on the software application such that the fracturing pumping plan may be displayed on the HMI 116. The fracturing pumping plan may be a set of instructions to perform multiple processes in a hydraulic fracturing pumping operation. In a non-limiting example, the instructions may include a sequence of valve operations to direct fluid flow through a selected path in one or more of the wellhead assemblies and manifolds on the frac pad, with the sequence of valve operations being automatically controlled by the software through a valve control system associated with the valves. Further, the HMI 116 may have an emulate mode that can visually show the path through which fluid can flow by monitoring the valve positions to determine current job state and provides choices for possible stages. The emulate mode may allow the operator 114 to simulate a next stage of the fracturing operation prior to making changes to the fracturing pumping plan. It is further envisioned that the software application may include a simulation system such that the fracturing pumping plan may be simulated and said results may be displayed on the HMI 116. Based on the simulated results, the fracturing pumping plan may be modified to create a customized fracturing pumping plan to be executed on the plurality of devices of the automated hydraulic fracturing pumping system 10. One skilled in the art will appreciate how the HMI 116 may allow the operator 114 to monitor, change, or shut down fracturing operation. In a non-limiting example, the HMI 116 may send permission requests to the operator 114 to perform various instructions from the fracturing pumping plan and/or the customized fracturing pumping plan. Additionally, the HMI 116 may include visual cues to allow for the monitoring and detection of a wireline stage, send alerts of a valve leak, and/or any erosion/corrosion caused by the flow of fluids in the plurality of devices.

In one or more embodiments, the plurality of sensors 111 may communicate with the software application on the computer system of the HMI 116 to automate the plurality of devices, such as a valve. In a non-limiting example, the fracturing pumping plan may include an automated valve sequencing (e.g., when to open and close) during completion stage based on pre-approved sequence as shown in FIGS. 2A-2G.

With reference to FIGS. 2A-2G, FIGS. 2A-2G show a non-limiting example of a fracturing pump plan of a hydraulic fracturing pumping system displayed on the HMI 116. A hydraulic fracturing pumping system 200 may include a first wellhead assembly 201*a* of a first well, a second wellhead assembly 201*b* of a second well, a third wellhead assembly 201*c* of a third well, and a fourth wellhead assembly 201*d* of a fourth well, which may be arranged and connected as they would be in the built hydraulic fracturing pumping system (see 100 of FIG. 1). For example, a manifold connection 210*a* may fluidly couple each wellhead assembly 201*a*-201*d* to a primary manifold connection 210*b* of a pump manifold (see 103 of FIG. 1). It is further that each wellhead assembly 201*a*-201*d* may have separate primary manifold connections connected to one pump manifold or separate pump manifolds.

In some embodiments, the hydraulic fracturing pumping system 200 may be operated by a single frac crew. Additionally, a second hydraulic fracturing pumping system, which may be arranged and connected as they would be in the built hydraulic fracturing pumping system (see 100 of FIG. 1), may also be operated by the single frac crew in parallel to the hydraulic fracturing pumping system 200. The single frac crew may apply the fracturing pump plan to both the hydraulic fracturing pumping system 200 and the second hydraulic fracturing pumping system simultaneously.

In one or more embodiments, the HMI 116 may further show positions of devices being monitored and/or controlled through the system. In a non-limiting example, the HMI 116 may display the open and closed positions of valves 220-228 in the hydraulic fracturing pumping system 200. For illustration purposes, closed valves are shown as blacked out while open valves are shown having no fill, thereby indicating the available path of fluid flow (see arrows 230-235) through the system. In a non-limiting example, a main valve 220 may be open to allow fluid flow (see arrow 230) from the primary manifold connection 210*b* to the manifold connection 210*a*. In the manifold connection 210*a*, the fluid flow (see arrow 230) may flow from one end to another. It is further envisioned that the HMI 116 may be a touch screen 250 such that the operator (see 114 of FIG. 1) may open and close valves 220-228 directly through the HMI 116.

Additionally, the HMI 116 may have one or more buttons or portions 251 of the touch screen 250 corresponding to commands in the hydraulic fracturing pumping system 200. Further, the HMI 116 may have a notification of current stage and alarming when a valve moves out of place, such that an automated notification of possible hazards in actuating certain valves may be displayed on the the HMI 116.

Figure 2A:
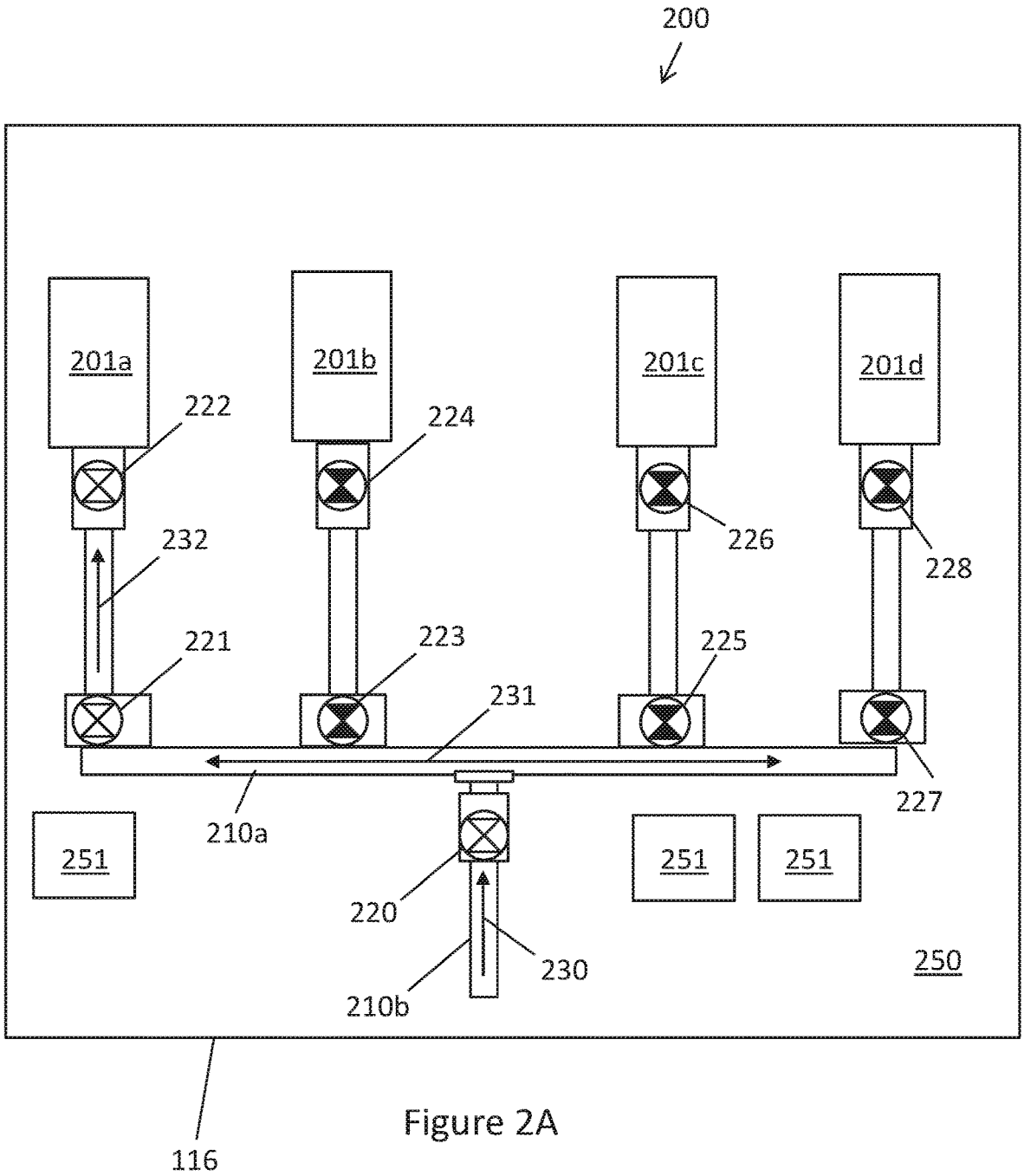
FIGS. 2A-2G illustrate views of a human machine interface ("HMI") of the hydraulic fracturing system of FIG. 1 according to one or more embodiments of the present disclosure.

Referring to FIG. 2A, the hydraulic fracturing pumping system 200 is shown with fluid flow (see arrow 232) to the first wellhead assembly 201*a*. When a frac stage of the first wellhead assembly 201*a* is at an end, a flush fluid may be pumped to flow (see arrow 232) at a full pump rate, such as a rate of about 50-150 bbl/min, into the first wellhead assembly 201*a* via a first set of valves 221, 222. The flush fluid may be fresh water and cleaning agents to flush out excess fracturing fluids (e.g., proppant) in the well of the first wellhead assembly 201*a*. Once a total volume of the flush fluid is pumped, a pump rate may be reduced from the full pump rate. For example, the pump rate may be reduced to 5-15 bbl/min. Once a pressure has stabilized at the reduced pump rate, the software application may move the fracturing pumping plan to the next step.

Figure 2B:
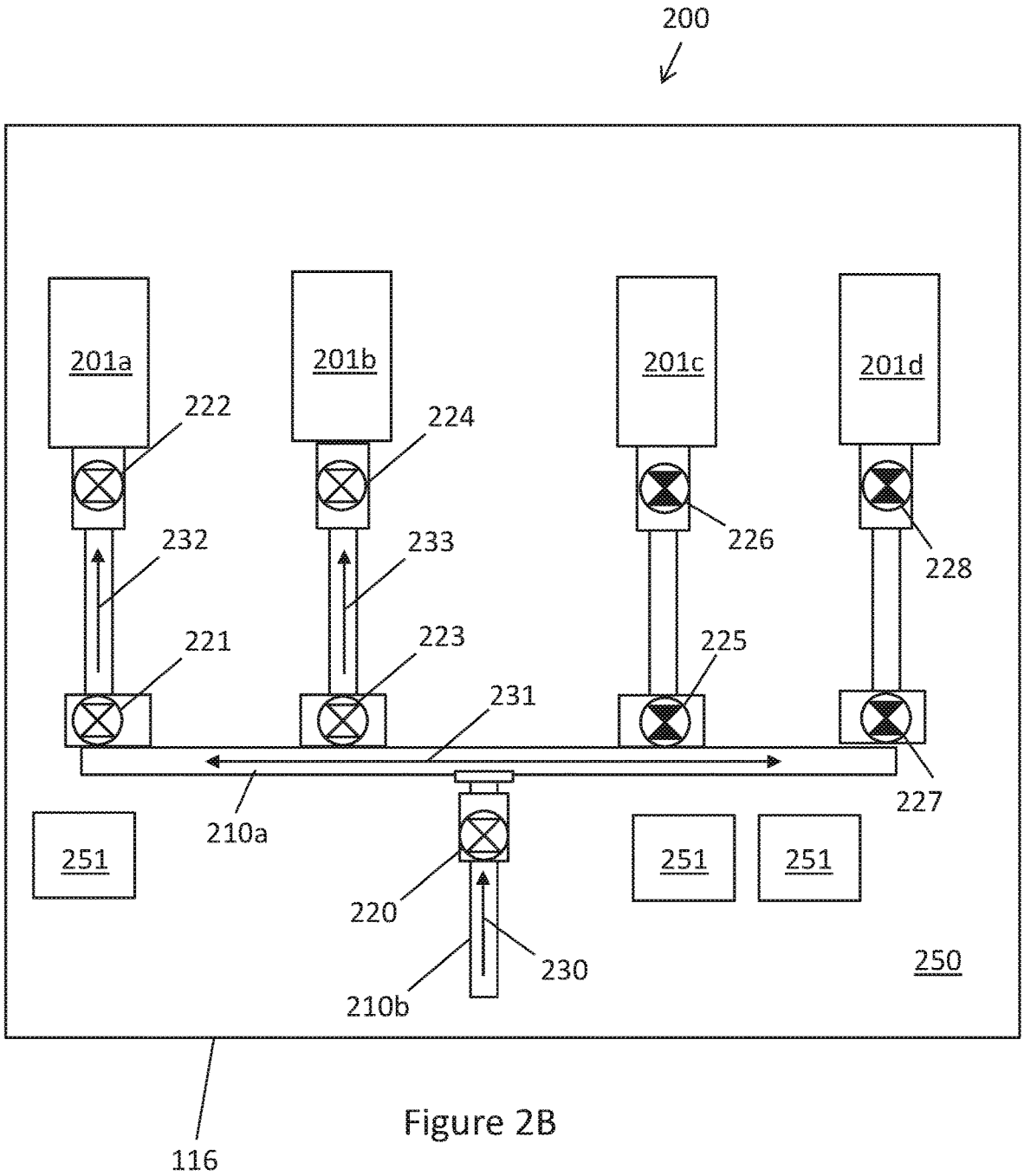
Figure 2C:
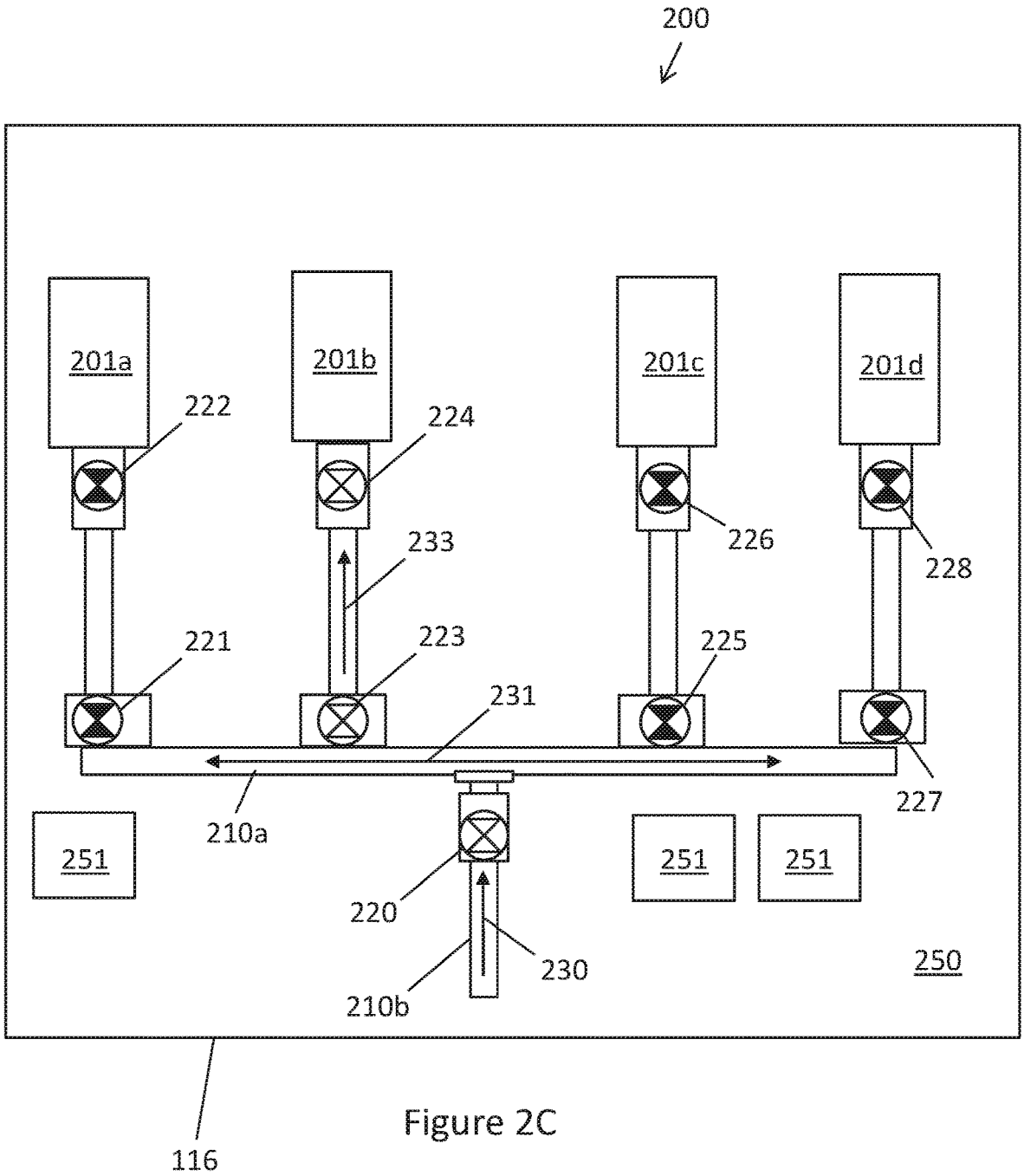

As shown in FIG. 2B, the fracturing pumping plan may include operating the second wellhead assembly 201*b* to conduct hydraulic fracturing pumping. For example, a second set of valves 223, 224 may be opened while the first set of valves 221, 222 remain open during the pumping of the flush fluid. With both the first set of valves 221, 222 and the second set of valves 223, 224 open, the flush fluid flows (see arrows 232, 233) into both the first wellhead assembly 201*a* and the second wellhead assembly 201*b*. Once injection is established and pressure has stabilized in both the first wellhead assembly 201*a* and the second wellhead assembly 201*b*, the first set of valves 221, 222 may be closed remotely to shut in the first wellhead assembly 201*a*, as shown by FIG. 2C. In FIG. 2C, the second wellhead assembly 201*b* may be isolated and hydraulic fracturing operations may be conducted. After hydraulic fracturing operations are conducted on the second wellhead assembly 201*b*, flush fluids may be pumped into the second wellhead assembly 201*b* and the pump rate may be reduced once a total volume of the flush fluid has been pumped.

Figure 2D:
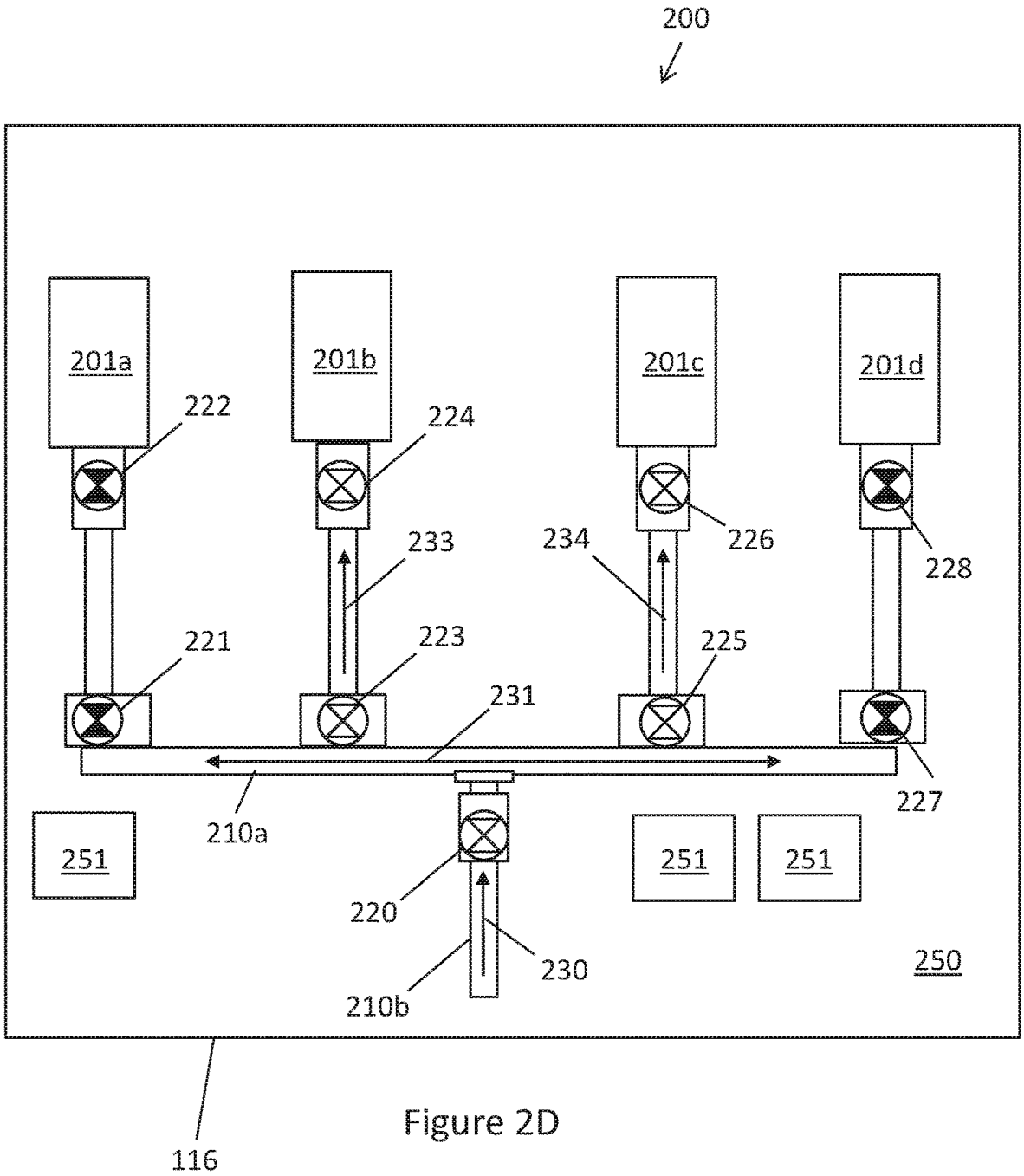

Referring to FIG. 2D, in one or more embodiments, the fracturing pumping plan may next open a third set of valves 225, 226 while the second set of valves 223, 224 are still open. With both the second set of valves 223, 224 and the third set of valves 225, 226 open, the flush fluid flows (see arrows 233, 234) into both the second wellhead assembly 201*b* and the third wellhead assembly 201*c*. Once injection is established and pressure has stabilized in both the second wellhead assembly 201*b* and the third wellhead assembly 201*c*, the second set of valves 223, 224 may be closed remotely to shut in the second wellhead assembly 201*b*, as shown by FIG. 2E.

Figure 2E:
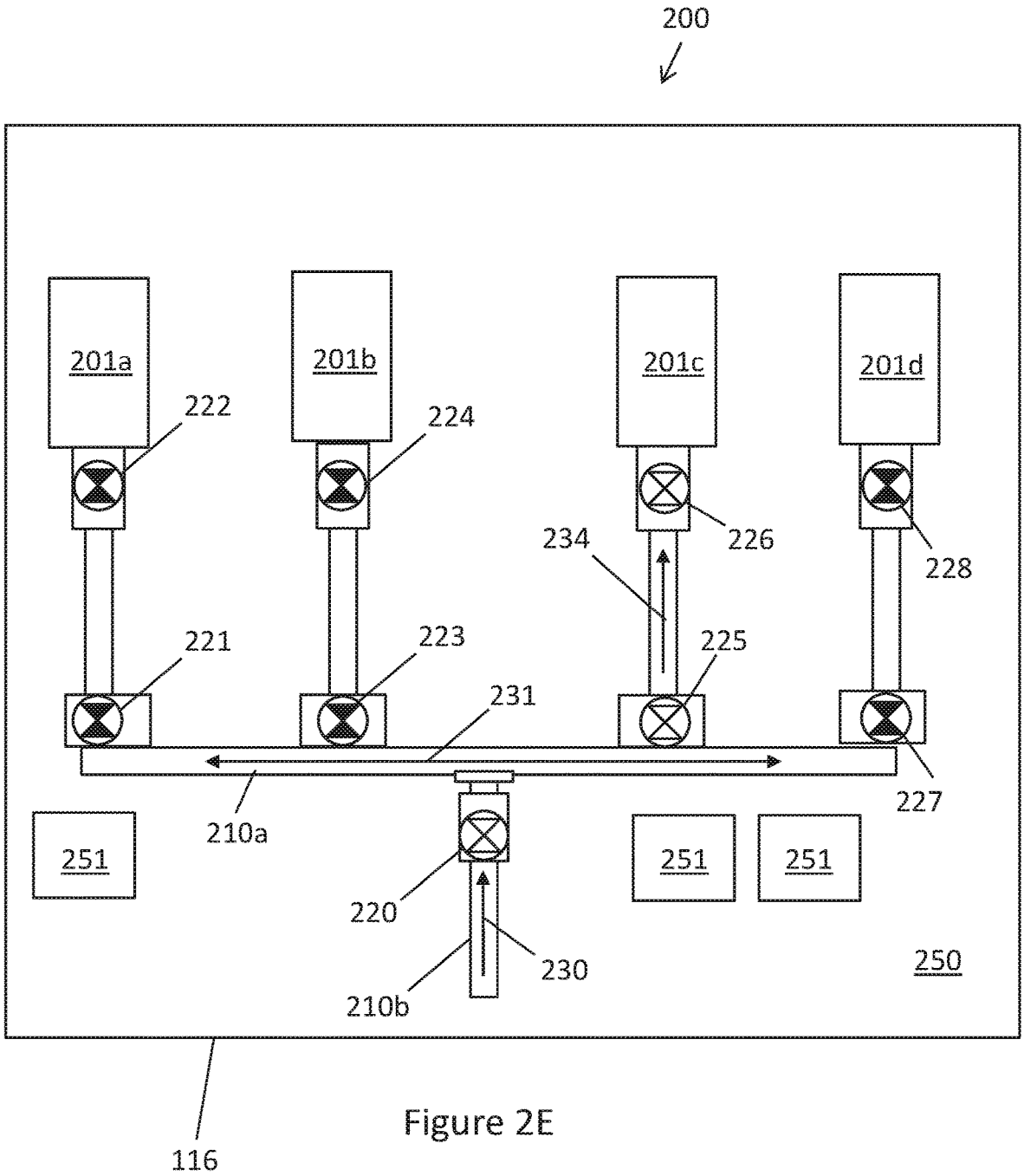
Figure 2F:
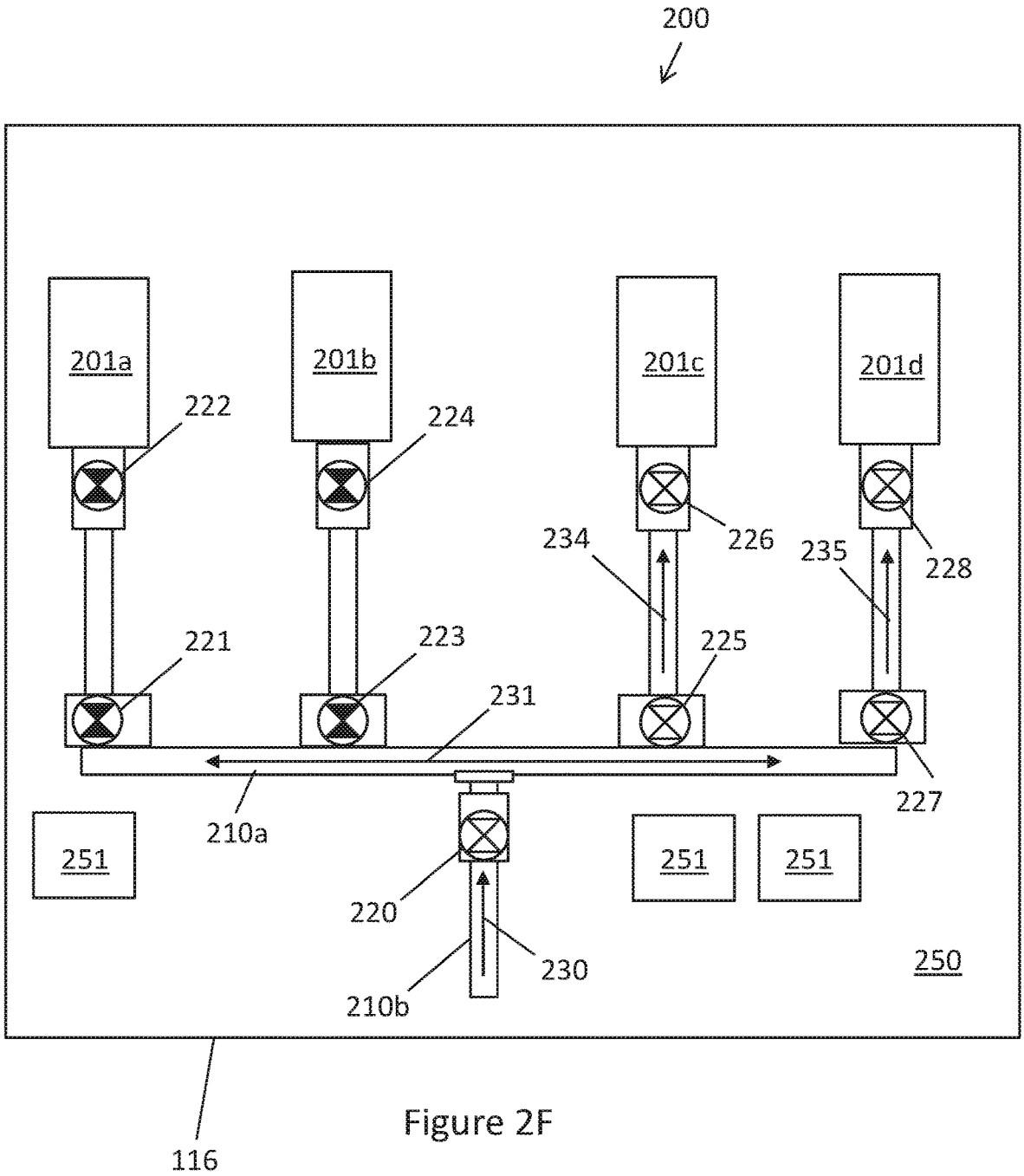
Figure 2G:
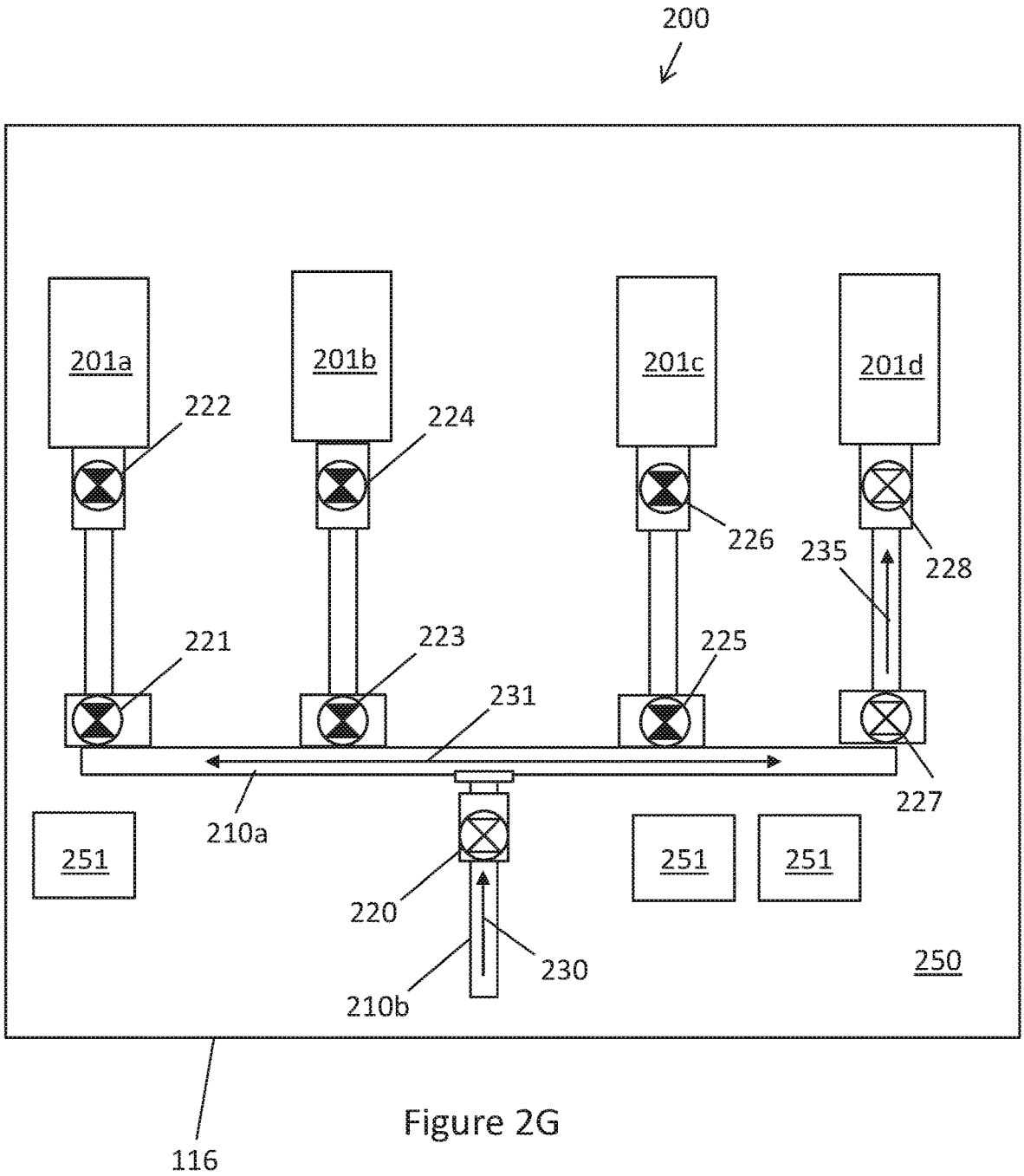

In FIG. 2E, the third wellhead assembly 201*c* may be isolated and hydraulic fracturing operations may be conducted. After hydraulic fracturing operations are conducted on the third wellhead assembly 201*c*, flush fluids may be pumped into the third wellhead assembly 201*c* and the pump rate may be reduced once a total volume of the flush fluid has been pumped. As shown by FIG. 2F, the fracturing pumping plan may next open a fourth set of valves 227, 228 while the third set of valves 225, 226 are still open. With both the third set of valves 225, 226 and the fourth set of valves 227, 228 open, the flush fluid flows (see arrows 234, 235) into both the third wellhead assembly 201*c* and the fourth wellhead assembly 201*d*. Once injection is established and pressure has stabilized in both the third wellhead assembly 201*c* and the fourth wellhead assembly 201*d*, the third set of valves 225, 226 may be closed remotely to shut in the third wellhead assembly 201*c*, as shown by FIG. 2G. In FIG. 2G, the fourth wellhead assembly 201*d* may be isolated and hydraulic fracturing operations may be conducted.

In one or more embodiments, FIGS. 2A-2G may provide continuous hydraulic fracturing pumping operations between the wellhead assemblies 201*a*-201*d*. While it is noted that FIGS. 2A-2G describes the sequence of the fracturing pumping plan from the first wellhead assembly 201*a* to the fourth wellhead assembly 201*d*, the sequence may be conducted between any of the wellhead assemblies 201*a*-201*d* in any order. Further, the sequence may be conducted from one wellhead assembly to a plurality of wellhead assemblies. It is further envisioned that after a certain number of continuous stages have been pumped, operations may be suspended for planned pump maintenance time. This time may be established up front in the fracturing pumping plan. After the planned maintenance window has closed, continuous pumping operations may automatically begin again. Advantageously, the transition time between stages may be effectively zero by using the fracturing pumping plan described in FIGS. 2A-2G. While described above with respect to transitioning from one well to a second well, embodiments herein also contemplate transitioning operations from two wells to two wells, etc. (one or more transitioning to one or more while continuously pumping). Furthermore, wireline operations may continue to operate during the fracturing pumping plan such that there is essentially no down time on operations waiting for the wireline.

In some embodiments, software on the HMI 116 of FIGS. 2A-2G may be used to simulate an outcome of a phase of the hydraulic fracturing pumping system 200 if selected devices were to be operated under certain parameters (e.g., if selected valves were opened or closed, if selected pumps were on or off, etc.). In some embodiments, the simulation may be used to evaluate performance and/or outcomes of hydraulic fracturing pumping operations that have not yet been built or have not yet been operated. In some embodiments, the simulation may be used to simulate actual performance of an already built and in-use hydraulic fracturing system in order to monitor and evaluate the actual performance, which may be used, for example, to help make decisions on next steps in the operation.

It is further envisioned that the plurality of sensors (see 111 of FIG. 1) may be used to determine a real-time condition of the plurality of devices, such as a valve (e.g., gate valve). In a non-limiting example, the software application, in one method, may instruct the plurality of sensors to monitor a hydraulic pressure and stroke signature of the valve. The software application may then correlate said readings with a known pattern determined by experimentally and theoretically calculated data on the valve operating under good lubrication. Further, the pressure stroke signature may be known to follow a fixed pattern for specific valves. In an additional approach, the software application may instruct the plurality of sensors to monitor hydraulic pressure spikes and volume of hydraulic fluid to determine a health status of the valve. Algorithms based on a valve type may be used to determine when the valve is failing due to, for example, poor greasing conditions. It is further envisioned that the plurality of sensors may utilize a combination of vibration and strain sensors to determine load on the valve stem and may correlate said load to an overall health of the valve. Furthermore, a safety measure may be programmed in the software application such that the plurality of sensors may automatically count a number of times a valve is opened and closed. The software application may use data based on the real-time valve position to prevent overpressure or other costly mistakes during the fracturing operations. It is further envisioned that safety and efficiency at the rig site may be increased by providing automated actuation of valves, remotely and outside of a red zone (e.g., an area proximate the plurality of devices).

According to embodiments of the present disclosure, a general plan suitable for use in planning a majority of hydraulic fracturing pumping operations may be generated into a template fracturing pumping plan. Thus, a template fracturing pumping plan may include an outline or overview of high-level phases for hydraulic fracturing pumping operations and an initial set of instructions for how activities within the high-level phases may be performed. A template fracturing pumping plan may later be modified (e.g., by an end user or third party) to accommodate a particular standard operating procedure or to fit a particular hydraulic fracturing pumping operation. For example, a user may modify a template fracturing pumping plan to include one or more discrete plans, for example, to fit a particular hydraulic fracturing pumping operation or standard operating procedure. One or more modifications to a template fracturing pumping plan may include, for example, alternating the timing of valve openings, alternating a particular valve leak test to perform for each kind of valve, and alternating pressure testing methods.

In some embodiments, a template fracturing pumping plan may be modified to include instructions for which steps in a hydraulic fracturing pumping operation can proceed with and without human permission. Permission settings may be predefined in a modified fracturing pumping plan to have certain steps require a user permission prior to proceeding and/or to have certain steps automatically proceed upon meeting certain system parameters. In some embodiments, permission settings may include one or more approval settings (e.g., who has credentials or who needs to approve certain steps in a hydraulic fracturing operation), a log of users and/or a log of decisions to approve or disallow actions and who made the decisions. As a simplified example of modifying a template fracturing pumping plan, a template fracturing pumping plan may include instructions that if steps a, b and c go according to plan in a built hydraulic fracturing pumping system, the operation may automatically proceed with step d, where the template fracturing pumping plan may be modified to request permission before proceeding with one or more of steps a, b, c and d.

Figure 3:
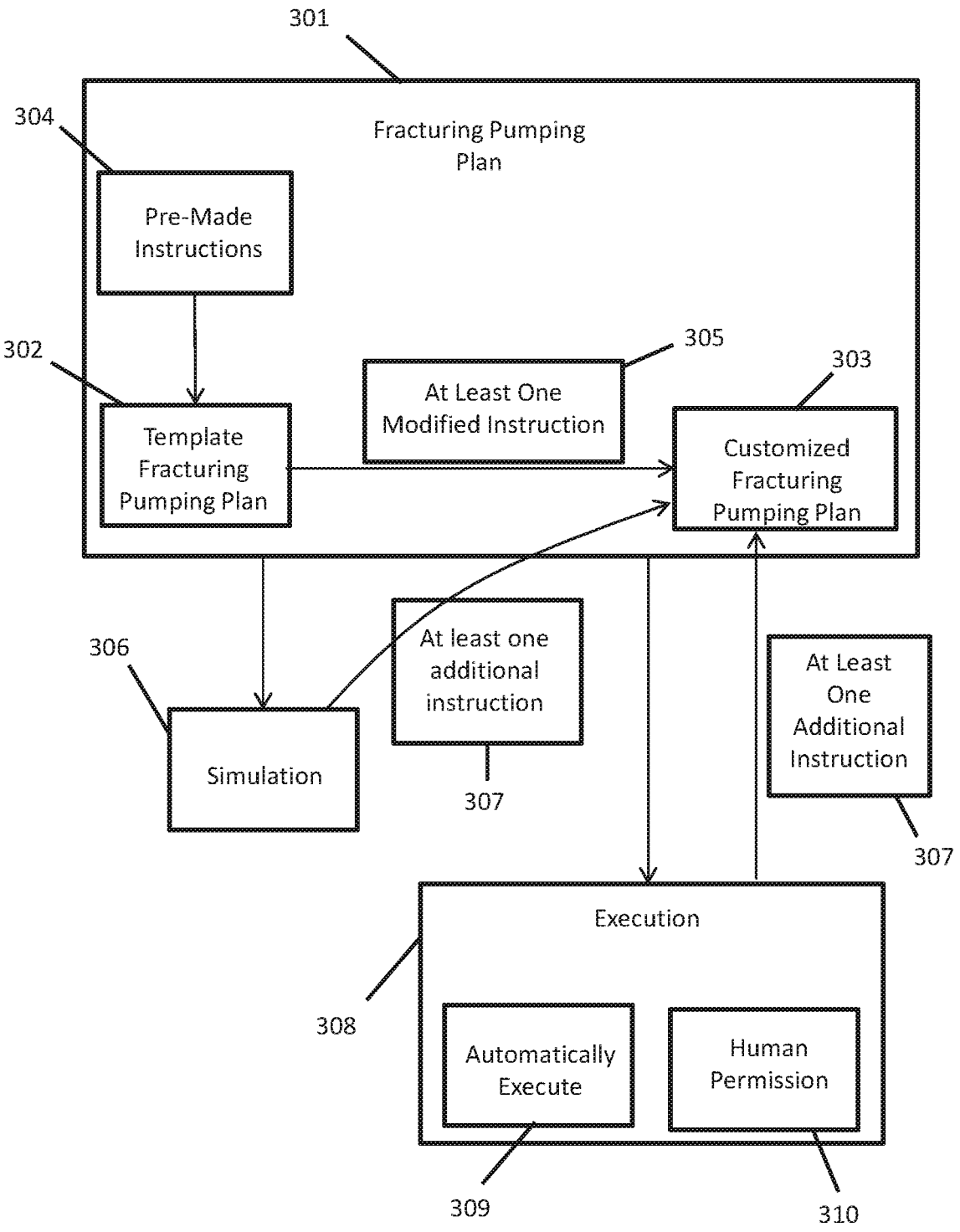
FIG. 3 illustrates a flowchart of automating a hydraulic fracturing system at a well site according to one or more embodiments of the present disclosure.

Referring to FIG. 3, in one or more embodiments, a system flow chart is shown of implementing an automated hydraulic fracturing pumping system on the built hydraulic fracturing pumping system 100 at the rig site 1 of FIG. 1. The automated hydraulic fracturing pumping system may include a fracturing pumping plan 301. In a non-limiting example, the fracturing pumping plan 301 may include a list of activities for each pumping phase of a hydraulic fracturing pumping operation as described in FIGS. 2A-2G. For each pumping phase, the fracturing pumping plan 301 may include settings for one or more device types in the hydraulic fracturing pumping system, such as on/off positions of each valve in the system, pressure minimums and maximums, and others described herein. Furthermore, one of ordinary skill in the art would understand the fracturing pumping plan 301 may include further operations, such as a water and additive injection, initiating the hydraulic fracturing of the formation, or any operation during the life of a well.

In some embodiments, the fracturing pumping plan 301 may be developed from one or more sets of pre-made instructions organized into a template fracturing pumping plan 302, which may include instructions to perform multiple processes carried out by the built hydraulic fracturing pumping system 100. In a non-limiting example, the template fracturing pumping plan 302 may be designed prior to building the built hydraulic fracturing pumping system 100 at a rig site such that the fracturing pumping plan 301 may apply to any configuration of the plurality of devices. It is further envisioned that the fracturing pumping plan 301 may be modified to form a customized fracturing pumping plan 303. The customized fracturing pumping plan 303 may include pre-made instructions 304 from the template fracturing pumping plan 302 and at least one modified instruction 305. In a non-limiting example, the at least one modified instruction 305 may be inputted into the software application by a third party such as an operator with access to the software application through the HMI.

In one or more embodiments, the fracturing pumping plan 301 (a template fracturing pumping plan 302 and/or a customized fracturing pumping plan 303) may be run in a simulation 306 prior to performing an operation at the rig site. In a non-limiting example, the software application may include a simulation package such that the simulation 306 may be run to show fluid flow through the plurality of devices of the built hydraulic fracturing pumping system 100 to a well bore or show the performance of individual components. It is further envisioned that the fracturing pumping plan 301 may use limit switches to determine the valve positions on a fracturing operation. In addition, said limit switches may be incorporated within an isolation valve, tree valve, and/or manifold valve to monitor and transit positions of said valves. One skilled in the art will appreciate how the positions of said valves may determine a current stage of a well as well as possible next stages during the fracturing operation. Further, the positions of said valve may be fed into a controller to enable a hydraulic valve to be automated in a safe manner.

Furthermore, a plurality of sensors (e.g., sensors 111 in FIG. 1) may be disposed in and/or on the plurality of devices to measure data. Further, it is also understood that depending on the piece of equipment (and its usage and/or importance), different numbers and/or types of sensors may be used. In a non-limiting example, the plurality of sensors 307 may collect data and display the data on the HMI to allow for real-time monitoring and updates. The plurality of sensors 307 are located on relevant equipment on locations where they can gather data and be able detect any changes to the plurality of devices such as performance and possible damage. For example, a pump may have a sensor disposed at the inlet thereof, as well as a sensor at the outlet thereof. Further examples may be a valve manifold that has a sensor disposed on the outer surface thereof, as well as a sensor on an inner flow bore, or a sensor may be disposed on a valve within the flow bore to measure a position of the valve. It is further envisioned that pressure lines may be measured in a central location, such that the sensor(s) connected to the pressure lines measures multiple pieces of equipment. Additionally, one of ordinary skill in the art will appreciate how the present discourse is not limited to just the data listed above and may include any effects on the plurality of devices.

With data collected from the plurality of sensors, in one or embodiments, an execution 308 of the fracturing pumping plan 301 (a template fracturing pumping plan 302 or a customized fracturing pumping plan 303) may be performed on the plurality of devices of the built hydraulic fracturing pumping system 100. In a non-limiting example, the software application may automatically execute 309 the fracturing pumping plan 301. In some embodiments, to perform the execution 308, the pre-made instructions and the at least one modified instruction may be sent to remotely operable hardware on the plurality of devices to perform a function (e.g., to achieve facture). It is further envisioned that an alert may occur on the HMI, such as a sound and/or visual cue. The alert may indicate that an operation requires human permission 310 to execute the customized fracturing plan prior to sending instructions to the plurality of devices. Additional alerts may also occur, such as from computer vision sensors that may detect personnel within an area of the built hydraulic fracturing pumping system 300 at the rig site (e.g., if an entity has come within a restricted or hazardous area of the rig site). Furthermore, the plurality of sensors may, for example, monitor pressure data at a high sample rate to capture high pressure events for compliance and safety requirements. Additionally, the fracturing pumping plan 301 may include a time to complete processes for each stage and the plurality of sensors may further provide information to modify said plans (301, 303) to improve operational efficiency.

According to embodiments of the present disclosure, data collected from simulation 306 of a fracturing pumping plan 301 and/or execution 308 of a fracturing pumping plan 301 may indicate that one or more additional instructions 307 may be added to a customized fracturing pumping plan 303 to optimize fracturing operations (e.g., make the operations safer, utilize less energy, utilize less material, etc.).

In one or more embodiments, the software application of the automated hydraulic fracturing pumping system may automatically generate optimal responses by using artificial intelligence ("AI") and/or machine learning ("ML"). In a non-liming example, the optimal responses may be due to unforeseen events such as downhole conditions changing, equipment failures, weather conditions, and/or hydraulic fracturing performance changing, where the fracturing pumping plan 301 may automatically change corresponding to the optimal responses. The optimal responses may optimally and automatically reroute the fracturing pumping plan 301 in view of the unforeseen events and potentially unidentified risks. It is further envisioned that the plurality of sensors may continuously feed the software application data, such that addition optimal responses may be suggested on the HMI for the operator to accept or reject. In some embodiments, the operator may manually input, through the HMI, modification to the fracturing pumping plan 301. One skilled in the art will appreciate how the software application, using AI and/or ML, may learn the manual input from the operator such that predications of potential interruptions in the fracturing pumping plan 301 may be displayed on the HMI and corresponding optimal responses.

Steps of a typical frac operation may include cleaning of a first well (pumping of flush fluid), frac fluid/sand injection into the first well, cleaning (injection of flush fluid) into the first well to remove the frac fluid, shutting in of the first well, then moving to the next well. In contrast, embodiments herein and as described above may be configured to allow the continuous pumping of fluids, connecting the initial and terminal "cleaning" portions of the frac operations of a first well and a second well, respectively. This will allow operations to not have to shut down and/or idle pumps while bleeding pressure. As a result, embodiments herein may essentially eliminate the time required to transition between wells, which may be up to or greater than 50 minutes per transition, for example. Continuous pumping may thus provide time benefits as well as the benefits of not losing prime on pumps, and reduced maintenance on pumps due to less frequent start up and shut down of the pumps.

In addition to the benefits described above, the automated hydraulic fracturing pumping system may improve an overall efficiency and performance at the rig site while reducing cost. In some embodiments, the efficiencies gained may allow for a single frac crew to be able to operate multiple frac operations occurring in parallel at the pad site. For example, a frac operation A, including a pumping system, a plurality of wells, etc., may be continuously pumping for operations of a first set of wells, frac operation B may be continuously pumping for operations at a second set of wells, and both operations may be manned and effectively operated by a single frac crew using the control systems and other equipment and configurations described herein, and where each frac operation may be transitioned from well to well while continuously pumping.

Further, the automated hydraulic fracturing pumping system may provide further advantages such as a complete closed loop valve control system, valve transitions may be recorded without visual inspection, partial valve transitions may be avoided, valve transition times may be optimized given the closed loop feedback, and human interaction may be reduced or eliminated with the rig equipment to reduce communication/confusion as a source of incorrect valve state changes. It is noted that the automated hydraulic fracturing pumping system may be used for onshore and offshore oil and gas operations.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

pumping fluids into a first well via at least one pump manifold by opening a first set of valves;

stabilizing a pressure in the first well by reducing a pump rate of the fluids to a reduced pump rate;

once the pressure in the first well is stabilized at the reduced pump rate, pumping the fluids into a second well via the at least one pump manifold while continuously pumping the fluids into the first well by opening a second set of valves;

closing the first set of valves to stop pumping the fluids into the first well; and isolating and continuously pumping the fluids into the second well.

2. The method of claim 1, further comprising, before closing the first set of valves, stabilizing a pressure in the first well and the second well.

3. The method of claim 2, wherein the stabilizing of the pressure in the first well and the second well comprises reducing a pump rate of the fluids.

4. The method of claim 1, further comprising:

pumping the fluids into a third well via the at least one pump manifold while continuously pumping the fluids into the second well by opening a third set of valves;

closing the second set of valves to stop pumping the fluids into the second well;

isolating and continuously pumping the fluids into the third well.

5. The method of claim 4, further comprising, before closing the second set of valves, stabilizing a pressure in the second well and the third well.

6. The method of claim 5, wherein the stabilizing of the pressure in the second well and the third well comprises reducing a pump rate of the fluids.

7. The method of claim 4, further comprising:

pumping the fluids into a fourth well via the at least one pump manifold while continuously pumping the fluids into the third well by opening a fourth set of valves;

closing the third set of valves to stop pumping the fluids into the third well;

isolating and continuously pumping the fluids into the fourth well.

8. The method of claim 7, further comprising, before closing the third set of valves, stabilizing a pressure in the third well and the fourth well.

9. The method of claim 8, wherein the stabilizing of the pressure in the third well and the fourth well comprises reducing a pump rate of the fluids.

* * * * *